US005756445A

United States Patent [19]

Dorset et al.

[11] Patent Number: 5,756,445

[45] Date of Patent: May 26, 1998

[54] GRANULAR DETERGENT COMPOSITION COMPRISING A LOW BULK DENSITY COMPONENT

[75] Inventors: Andrew Dorset; Robin Gibson Hall, both of Newcastle upon Tyne, United Kingdom

[73] Assignee: The Proctor & Gamble Company, Cincinnati, Ohio

[21] Appl. No.: 637,700

[22] PCT Filed: Oct. 11, 1994

[86] PCT No.: PCT/US94/11511

§ 371 Date: Jul. 30, 1996

§ 102(e) Date: Jul. 30, 1996

[87] PCT Pub. No.: WO95/13344

PCT Pub. Date: May 18, 1995

[30] Foreign Application Priority Data

Nov. 11, 1993 [EP] European Pat. Off. ..... 93309042

[51] Int. Cl.[6] ..... C11D 17/00; C11D 1/14; C11D 3/12; C11D 17/06

[52] U.S. Cl. ..... 510/357; 510/310; 510/315; 510/318; 510/349; 510/361; 510/377; 510/438; 510/441; 510/442; 510/443; 510/444; 510/445; 510/452; 510/495; 510/507; 510/532

[58] Field of Search ..... 510/507, 532, 510/315, 323, 377, 443, 444, 452, 310, 318, 349, 351, 357, 361, 438, 441, 442, 445, 495; 252/246

[56] References Cited

U.S. PATENT DOCUMENTS

| | | | |
|---|---|---|---|
| 4,022,874 | 5/1977 | Mollard et al. | 423/415.2 |
| 4,140,650 | 2/1979 | Wilde | 510/356 |
| 4,190,635 | 2/1980 | Mésaros et al. | 423/415.2 |
| 4,478,735 | 10/1984 | Yazaki et al. | 510/452 |
| 4,639,326 | 1/1987 | Czempik et al. | 510/377 |
| 4,755,318 | 7/1988 | Davies et al. | 510/351 |
| 4,931,203 | 6/1990 | Ahmed et al. | 510/230 |
| 5,139,693 | 8/1992 | Wilms et al. | 510/438 |
| 5,151,208 | 9/1992 | Huijben et al. | 510/452 |
| 5,219,549 | 6/1993 | Onda et al. | 423/415.2 |
| 5,423,997 | 6/1995 | Ahmed et al. | 510/226 |
| 5,576,285 | 11/1996 | France et al. | 510/444 |

*Primary Examiner*—Ardith Hertzog

*Attorney, Agent, or Firm*—Ken K. Patel; Kim W. Zerby; Jacobus C. Rasser

[57] ABSTRACT

A granular detergent component having a bulk density of less than 400 g/l comprises from 20% to 50%, by weight, of aluminosilicate, optionally up to 50%, by weight, of a co-filler, and 0.05% to 2%, by weight, of anionic surfactant, preferably C14–C20 alkyl sulphate. The low bulk density component is preferably mixed with other components such as percarbonate, silicate, layered silicate, carbonate, bicarbonate, sesquicarbonate, sulphate, citrate and mixtures thereof to provide a granular detergent composition.

21 Claims, No Drawings

GRANULAR DETERGENT COMPOSITION COMPRISING A LOW BULK DENSITY COMPONENT

The invention concerns a granular detergent component having a bulk density of less than 400 g/l which comprises an anionic surfactant, zeolite, and, optionally, a co-filler. The invention also concerns a granular laundry detergent composition comprising the low bulk density component and, additionally, high density granular components, preferably including percarbonate.

In conventional processes for preparing granular laundry detergents, spray drying of an aqueous slurry has been used to prepare granular components having a rather wide range of bulk densities depending on factors such as choice and level of ingredients used in the slurry, and processing conditions in the spray drying tower. However spray dried products on their own do not have high enough bulk density for todays granular detergents.

Recent trends in granular laundry detergents have seen increases in the bulk density of the finished products. Such high bulk densities offer greater convenience to the consumer, and environmental benefits due to, for example, reduced packaging requirements. These densities have been achieved by preparing and combining individual detergent components having high bulk densities. Combinations of spray dried powders with other granular components are known in the prior art, some examples of which are cited below.

EPA289312, published Nov. 2, 1988 discloses a process for the spray-drying of an aqueous slurry which contains carbonate and a crystal growth modifier. Optional post-treatments include spraying on of nonionic surfactant and mixing with other components including bleach, bleach activator, enzymes, etc. Such components require the presence of relatively high levels of organic materials, in particular anionic surfactants (in this application surfactants are present at a level of at least 5% by weight).

W09303131, published on Feb. 18, 1993 discloses a spray dried component which comprises alkyl sulphate, aluminosilicate and silicate. Certain ratios of the components as well as processing conditions are specified. The spray dried component is then mixed with bleach, bleach activator, foam inhibitor, enzymes etc. The application considers the problem of replacing linear alkyl benzene sulponate (LAS) by the more biodegradable alkyl sulphates. Such components are difficult to spray dry and require the introduction of specific process parameters such as low temperature spray drying.

High bulk density components which are desirable in todays granular detergents, such as carbonate, percarbonate and silicate, do not offer the detergent formulator much flexibility in terms of finished product bulk density. A low bulk density spray-dried component, however, which could be blended with the high bulk density components would offer greatly increased flexibility in terms of achieving the desired final product density. Such flexibility arises from the possibility to vary parameters such as the composition of the aqueous slurry prior to spray drying, the parameters of the spray drying process and the ratio of the low bulk density component to the high bulk density components which may be used.

It is the aim of the present invention to provide a spray-dried component having a bulk density of less than 400 g/l which contains a low level of organic material. The organic material facilitates the production of spray dried components having good physical properties, and which can be made at a low bulk density without loss of quality. The organic material chosen for use in the present invention is low levels of surfactant, preferably anionic surfactant at a level of from 0.05% to 2% by weight, which has a Krafft point of at least 30° C.

A second aspect of the present invention is to provide a finished composition which comprises the low bulk density spray-dried component, together with additional higher bulk density components.

A third aspect of the present invention is to provide spray-dried components which are low in moisture content, and which have a high capacity for moisture uptake. Such components, when combined with granular percarbonate offer improved storage stability of the percarbonate, especially in humid conditions.

DETAILED DESCRIPTION OF THE INVENTION

In its first aspect the present invention is concerned with a granular detergent component having a bulk density of less than 400 g/l comprising from 20% to 50% by weight of aluminosilicate, and optionally up to 50% by weight of a co-filler. The granular components of the invention further comprise from 0.05% to 2% by weight of anionic surfactant. The anionic surfactant may be used alone, or it may be combined with non-anionic surfactants. The anionic surfactant, or mixture of anionic and non-anionic surfactants (when present), has a Krafft Point greater than 30° C. Preferably the anionic surfactant is present at a level of from 1% to 1.8%, and is C14–C20 alkyl sulphate.

Preferably the co-filler is a hydratable inorganic salt selected from the group of salts consisting of carbonate, bicarbonate, sesquicarbonate, sulphate, citrate or mixtures of these, and is present at a level of from 10 to 30% by weight of the low bulk density component.

In its second aspect, the low bulk density component is mixed with other components. Such granular components preferably include those selected from the group consisting of silicate, layered silicate, carbonate, bicarbonate, sesquicarbonate, sulphate, citrate or mixtures of these. It is preferred that the spray-dried component is present in the composition at a level of from 10% to 60% by weight, and that the granular components which individually have a bulk density of greater than 800 g/l are present, when mixed together in the composition at a level of up to 50% by weight, preferably from 10 to 40%.

In its third aspect the composition further comprises granular percarbonate having a bulk density of at least 800 g/l. Where present the percarbonate is preferably at a level of greater than 3% by weight of the finished composition, and more preferably from 5% to 50% by weight of the finished composition. In such a percarbonate containing composition, the spray dried component is processed so that therein the ratio of total water to aluminosilicate does not exceed 1:3, preferably does not exceed 1:5.

The various detergent ingredients are defined in more detail below.

Surfactants

The surfactants which are useful as components of the low bulk density component of the present invention are those having a Krafft Point greater than 30° C.

Water-soluble salts of the higher fatty acids, i.e., "soaps", are useful anionic surfactants in the compositions herein. This includes alkali metal soaps such as the sodium, potassium, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soap. Those soaps having a chain length of at least 12 carbon atoms are especially useful in the present invention because they have Krafft points in the required range.

Useful anionic surfactants also include the water-soluble salts, preferably the alkali metal, ammonium and alkylolammonium salts, of organic sulfuric reaction products having in their molecular structure an alkyl group containing from about 10 to about 20 carbon atoms and a sulfonic acid or sulfuric acid ester group. Examples of this group of synthetic surfactants are the sodium and potassium alkyl sulfates, especially those obtained by sulfating the higher alcohols ($C_8$–$C_{18}$ carbon atoms) such as those produced by reducing the glycerides of tallow or coconut oil. Those alkyl sulphates having a chain length of at least 14 carbon atoms are especially useful in the present invention because they have Krafft points in the required range.

Other useful anionic surfactants herein include the water-soluble salts of esters of alpha-sulfonated fatty acids containing from about 6 to 20 carbon atoms in the fatty acid group and from about 1 to 10 carbon atoms in the ester group; and alkyl ether sulfates containing from about 10 to 20, especially 16 to 20, carbon atoms in the alkyl group and from about 1 to 30 moles of ethylene oxide.

Also useful are the sulphonation products of fatty acid methyl esters containing a alkyl group with from 10 to 20 carbon atoms. Preferred are the C16–18 methyl ester sulphonates (MES).

Particularly preferred surfactants herein include; primary and secondary alkyl sulfates; coconutalkyl glyceryl ether sulfonates; alkyl ether sulfates wherein the alkyl moiety contains from about 16 to 18 carbon atoms and wherein the average degree of ethoxylation is from about 1 to 4; olefin or paraffin sulfonates containing from about 16 carbon atoms; and methyl ester sulphonates.

Preferred nonionics are the water-soluble condensation products of aliphatic alcohols containing from 8 to 22 carbon atoms, in either straight chain or branched configuration, with from 4 to 25 moles of ethylene oxide per more of alcohol. Particularly preferred are the condensation products of alcohols having an alkyl group containing from about 9 to 15 carbon atoms with from about 4 to 25 moles of ethylene oxide per mole of alcohol; and condensation products of propylene glycol with ethylene oxide.

Another class of nonionic surfactants comprises alkyl polyglucoside compounds of general formula $$RO\ (C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.3 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

Still another class of nonionic surfactants comprises polyhydroxy fatty acid amides which may be produced by reacting a fatty acid ester and an N-alkyl polyhydroxy amine. A preferred amine is N-(R1)-CH2(CH2OH)4-CH2-OH and the preferred ester is a C12-C20 fatty acid methyl ester. Most preferred is the reaction product of N-methyl glucamine with C12–C20 fatty acid methyl ester.

Methods of manufacturing polyhydroxy fatty acid amides have been described in WO 92 6073, published on Apr. 16, 1992. This application describes the preparation of polyhydroxy fatty acid amides in the presence of solvents. In a highly preferred embodiment of the invention N-methyl glucamine is reacted with a C12–C20 methyl ester.

One class of nonionic surfactants useful in the present invention comprises condensates of ethylene oxide with a hydrophobic moiety, providing surfactants having an average hydrophilic-lipophilic balance (HLB) in the range from 8 to 17, preferably from 9.5 to 13.5, more preferably from 10 to 12.5. The hydrophobic (lipophilic) moiety may be aliphatic or aromatic in nature and the length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_9$–$C_{15}$ primary alcohol ethoxylates containing 3–9 moles of ethylene oxide per mole of alcohol, particularly the $C_{13}$–$C_{15}$ primary alcohols containing 6–9 moles of ethylene oxide per mole of alcohol and the $C_{11}$–$C_{15}$ primary alcohols containing 3–5 moles of ethylene oxide per mole of alcohol.

Surfactants which have a Krafft Point of less than 30° C. are not excluded from the present invention, but they should be used in combination with high Krafft Point surfactants in surfactant systems at levels whereby the total surfactant system has a Krafft Point in excess of 30° C.

Anionic surfactant having a lower Krafft Point which may be used in this way include sodium and potassium alkyl benzene sulfonates in which the alkyl group contains from about 9 to about 15 carbon atoms, in straight or branched chain configuration, e.g., those of the type described in U.S. Pat. Nos. 2,220,099 and 2,477,383. Especially valuable are linear straight chain alkyl benzene sulfonates in which the average number of carbon atoms in the alkyl group is from about 11 to 13, abbreviated as $C_{11}$–$C_{13}$ LAS.

Other classes of surfactants include the following:

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

The low bulk density component of the present invention comprises other detergent ingredients selected from a wide range of possible ingredients which are commonly used in laundry detergents. The particles will contain from 20 to 50% by weight of aluminosilicate and up to 50% by weight of co-filler, and optionally other components; preferred components being described below.

Whilst a range of aluminosilicate ion exchange materials can be used, preferred sodium aluminosilicate zeolites have the unit cell formula $$Na_z[(AlO_2)_z(SiO_2)_y]xH_2O$$

wherein z and y are at least 6; the molar ratio of z to y is from 1.0 to 0.5 and x is at least 5, preferably from 7.5 to 276, more preferably from 10 to 264. The aluminosilicate materials are in hydrated form and are preferably crystalline, containing from 10% to 28%, more preferably from 16% to 22% water in bound form.

The above aluminosilicate ion exchange materials are further characterised by a particle size diameter of from 0.1 to 10 micrometers, preferably from 0.2 to 4 micrometers. The term "particle size diameter" herein represents the average particle size diameter of a given ion exchange material as determined by conventional analytical techniques such as, for example, microscopic determination utilizing a scanning electron microscope or by means of a laser granulometer. The aluminosilicate ion exchange materials are further characterised by their calcium ion exchange capacity, which is at least 200 mg equivalent of $CaCO_3$ water hardness/g of aluminosilicate, calculated on an anhydrous basis, and which generally is in the range of from 300 mg eq./g to 352 mg eq./g. The aluminosilicate ion exchange materials herein are still further characterised by their calcium ion exchange rate which is at least 130 mg equivalent of $CaCO_3$/liter/minute/(g/liter) [2 grains $Ca^{++}$/gallon/minute/gram/gallon)] of aluminosilicate (anhydrous basis), and which generally lies within the range of from 130 mg equivalent of $CaCO_3$/liter/minute/(gram/liter) [2 grains/gallon/minute/ (gram/gallon)] to 390 mg equivalent of $CaCO_3$/liter/minute/ (gram/liter) [6 grains/gallon/minute/(gram/gallon)], based on calcium ion hardness.

Optimum aluminosilicates for builder purposes exhibit a calcium ion exchange rate of at least 260 mg equivalent of $CaCO_3$/liter/ minute/ (gram/liter) [4 grains/gallon/minute/(gram/gallon)].

Aluminosilicate ion exchange materials useful in the practice of this invention are commercially available and can be naturally occurring materials, but are preferably synthetically derived. A method for producing aluminosilicate ion exchange materials is discussed in U.S. Pat. No. 3,985,669. Preferred synthetic crystalline aluminosilicate ion exchange materials useful herein are available under the designations Zeolite A, Zeolite B, Zeolite X, Zeolite HS, Zeolite MAP and mixtures thereof. In an especially preferred embodiment, the crystalline aluminosilicate ion exchange material is Zeolite A and has the formula $$Na_{12}[(AlO_2)_{12}(SiO_2)_{12}].xH_2O$$

wherein x is from 20 to 30, especially 27. Zeolite X of formula $Na_{86}[(AlO_2)_{86}(SiO_2)_{106}]$. 276 $H_2O$ is also suitable, as well as Zeolite HS of formula $Na_6[(AlO_2)_6(SiO_2)_6]7.5 H_2O$.

Suitable co-fillers can include, but are not restricted to, alkali metal carbonates, bicarbonates, sesquicarbonates, sulphates, monomeric polycarboxylates, salts of homo or copolymeric polycarboxylic acids in which the polycarboxylic acid comprises at least two carboxylic radicals separated from each other by not more than two carbon atoms, organic phosphonates and aminoalkylene poly (alkylene phosphonates) and mixtures of any of the foregoing.

By the term "hydratable salt" it is meant that the salt is in a state in which it may absorb additional water by hydration. That is to say that the salt is present either in its anhydrous form, or in a partially hydrated form.

Preferred builder systems are free of boron compounds and any polymeric organic materials are preferably biodegradable.

Suitable water-soluble monomeric or oligomeric carboxylate builders include lactic acid, glycolic acid and ether derivatives thereof as disclosed in Belgian Patent Nos. 831,368, 821,369 and 821,370. Polycarboxylates containing two carboxy groups include the water-soluble salts of succinic acid, malonic acid, (ethylenedioxy) diacetic acid, maleic acid, diglycolic acid, tartaric acid, tartronic acid and fumaric acid, as well as the ether carboxylates described in German Offenlegenschrift 2,446,686, and 2,446,687 and U.S. Pat. No. 3,935,257 and the sulfinyl carboxylates described in Belgian Patent No. 840,623. Polycarboxylates containing three carboxy groups include, in particular, water-soluble citrates, aconitrates and citraconates as well as succinate derivatives such as the carboxymethyloxysuccinates described in British Patent No. 1,379,241, lactoxysuccinates described in British Patent No. 1,389,732, and aminosuccinates described in Netherlands Application 7205873, and the oxypolycarboxylate materials such as 2-oxa-1,1,3-propane tricarboxylates described in British Patent No. 1,387,447.

Polycarboxylates containing four carboxy groups include oxydisuccinates disclosed in British Patent No. 1,261,829, 1,1,2,2-ethane tetracarboxylates, 1,1,3,3-propane tetracarboxylates and 1,1,2,3-propane tetracarboxylates. Polycarboxylates containing sulfo substituents include the sulfosuccinate derivatives disclosed in British Patent Nos. 1,398,421 and 1,398,422 and in U.S. Pat. No. 3,936,448, and the sulfonated pyrolysed citrates described in British Patent No. 1,439,000.

Another preferred polycarboxylate builder is ethylenediamine-N,N'-disuccinic acid (EDDS) or the alkali metal, alkaline earth metal, ammonium, or substituted ammonium salts thereof, or mixtures thereof.

Alicyclic and heterocyclic polycarboxylates include cyclopentane-cis,cis,cis-tetracarboxylates, cyclopentadienide pentacarboxylates, 2,3,4,5-tetrahydrofuran-cis,cis,cis-tetracarboxylates, 2,5-tetrahydrofuran-cis-dicarboxylates, 2,2,5,5-tetrahydrofuran-tetracarboxylates, 1,2,3,4,5,6-hexane-hexacarboxylates and carboxymethyl derivatives of polyhydric alcohols such as sorbitol, mannitol and xylitol. Aromatic polycarboxylates include mellitic acid, pyromellitic acid and the phthalic acid derivatives disclosed in British Patent No. 1,425,343. Of the above, the preferred polycarboxylates are hydroxycarboxylates containing up to three carboxy groups per molecule, more particularly citrates.

The parent acids of the monomeric or oligomeric polycarboxylate chelating agents or mixtures thereof with their salts, e.g. citric acid or citrate/citric acid mixtures are also contemplated as components of builder systems of detergent compositions in accordance with the present invention.

Other suitable water soluble organic salts are the homo- or co-polymeric polycarboxylic acids or their salts in which the polycarboxylic acid comprises at least two carboxyl radicals separated from each other by not more than two carbon atoms. Polymers of the latter type are disclosed in GB-A-1,596,756. Examples of such salts are polyacrylates of MWt 2000–5000 and their copolymers with maleic anhydride, such copolymers having a molecular weight of from 20,000 to 70,000, especially about 40,000. These materials are normally used at levels of from 0.5% to 10% by weight more preferably from 0.75% to 8%, most preferably from 1% to 6% by weight of the composition.

Organic phosphonates and amino alkylene poly (alkylene phosphonates) include alkali metal ethane 1-hydroxy diphosphonates, nitrilo trimethylene phosphonates, ethylene diamine tetra methylene phosphonates and diethylene triamine penta methylene phosphonates, although these materials are less preferred where the minimisation of phosphorus compounds in the compositions is desired.

The primary component of the present invention has a bulk density of less than 400 g/l and is preferably prepared by spray drying, although other techniques of preparing low density flowable powders may be used. Following the spray drying route, an aqueous slurry is prepared comprising the solids. The slurry is then pumped at high pressure through atomising nozzles into a drying tower where excess water is driven off, producing a flowable powder. The resulting powder may then be oversprayed with liquid ingredients, especially nonionic surfactants for which the powder has a high adsorption capacity before it loses its good flow characteristics.

Examples of other components which may be used in laundry detergents, and which may be incorporated into the low bulk density component are described below under "Other Optional Ingredients"

Percarbonate bleach

In a preferred embodiment of the present invention, compositions will include a percarbonate bleach, normally in the form of the sodium salt, as the source of alkaline hydrogen peroxide in the wash liquor. This percarbonate is normally incorporated at a level of from 3% to 50% by weight, more preferably from 5% to 30% by weight and most preferably from 8% to 25% by weight of the total composition.

Sodium percarbonate is an addition compound having a formula corresponding to $2Na_2CO_3.3H_2O_2$, and is available commercially as a crystalline solid. Most commercially available material includes a low level of a heavy metal sequestrant such as EDTA, 1-hydroxyethylidene 1,1-diphosphonic acid (HEDP) or an amino-phosphonate, that is incorporated during the manufacturing process. For the purposes of the detergent composition aspect of the present invention, the percarbonate can be incorporated into detergent compositions without additional protection, but preferred executions of such compositions utilise a coated form of the material. The preferred coating is a mixed salt of an alkali metal sulphate and carbonate. Such coatings together with coating processes have previously been described in GB-1,466,799, granted to Interox on Mar. 9, 1977. The weight ratio of the mixed salt coating material to percarbonate lies in the range from 1:200 to 1:4, more preferably from 1:99 to 1:9, and most preferably from 1:49 to 1:19. Preferably, the mixed salt is of sodium sulphate and sodium carbonate which has the general formula $Na_2SO_4.n.Na_2CO_3$ wherein n is from 0.1 to 3, preferably n is from 0.3 to 1.0 and most preferably n is from 0.2 to 0.5. Another preferred coating material is citrate, or mixtures of citrate with sulphate or carbonate. Water soluble surfactants may also be used as coating materials.

An alternative, although less preferred coating material is sodium silicate of $SiO_2$:$Na_2O$ ratio from 1.6:1 to 3.4:1, preferably 2.8:1, applied as an aqueous solution to give a level of from 2% to 10%, (normally from 3% to 5%) of silicate solids by weight of the percarbonate. Magnesium silicate can also be included in the coating. However silicate should not be the major coating agent in order to maintain good dispensing properties. If present, the silicate level in the coating should be less than 3% by weight of the percarbonate.

The particle size range of the crystalline percarbonate is from 150 micrometers to 1500 micrometers, preferably from 250 micrometers to 1000 micrometers with a mean particle size of from 500 micrometers to 700 micrometers.

Whilst heavy metals present in the sodium carbonate used to manufacture the percarbonate can be controlled by the inclusion of sequestrants in the reaction mixture, the percarbonate still requires protection from heavy metals present as impurities in other ingredients of the product.

Granular Sodium Silicate

Suitable silicates are those having an $SiO_2$:$Na_2O$ ratio in the range from 1.6 to 3.4, the so-called amorphous silicates of $SiO_2$: $Na_2O$ ratios from 2.0 to 2.8 being preferred. These materials can be added at various points of the manufacturing process, such as in the form of an aqueous solution serving as an agglomerating agent for other solid components, or, where the silicates are themselves in particulate form, as solids to the other particulate components of the composition.

Within the silicate class, highly preferred materials are crystalline layered sodium silicates of general formula $$NaMSi_xO_{2+1}.yH_2O$$

wherein M is sodium or hydrogen, x is a number from 1.9 to 4 and y is a number from 0 to 20. Crystalline layered sodium silicates of this type are disclosed in EP-A-0164514 and methods for their preparation are disclosed in DE-A-3417649 and DE-A-3742043. For the purposes of the present invention, x in the general formula above has a value of 2, 3 or 4 and is preferably 2. More preferably M is sodium and y is 0 and preferred examples of this formula comprise the α,β,γ and δ forms of $Na_2Si_2O_5$. These materials are available from Hoechst AG FRG as respectively NaSKS-11 and NaSKS-6. The most preferred material is δ-$Na_2Si_2O_5$, (NaSKS-6). Crystalline layered silicates are incorporated either as dry mixed solids, or as solid components of agglomerates with other components.

Other ingredients which may be dry added into the composition in their granular form include carbonate, bicarbonate, sesquicarbonate, sulphate, citrate or mixtures of these all of which have been described above. Furthermore some components may be added in the granular form of the acid, for example citric acid. It will be understood that such granulates may consist solely of one component, or may be co-granulates of two of more components.

Additional Surfactant-Comprising Components

Granular components which also comprise substantial amounts of surfactants may also be dry added into the finished composition. Such surfactant particles of the present invention may take the form of flakes, prills, marumes, noodles, ribbons, but preferably take the form of granules. A preferred way to process the particles is by agglomerating powders (such as those described hereinabove e.g. aluminosilicate, carbonate) with high active surfactant pastes and to control the particle size of the resultant agglomerates within specified limits. Such a process involves mixing an effective amount of powder with a high active surfactant paste in one or more agglomerators such as a pan agglomerator, a Z-blade mixer or more preferably an in-line mixer such as those manufactured by Schugi (Holland) BV, 29 Chroomstraat 8211 AS, Lelystad, Netherlands, and Gebruder Lodige Maschinenbau GmbH, D-4790 Paderborn 1, Elsenerstrasse 7-9, Postfach 2050, Germany. Most preferably a high shear mixer is used , such as a Lodige CB (Trade Name).

A high active surfactant paste comprising from 50% by weight to 100% by weight, preferably 70% by weight to 85% by weight of surfactant is used. The surfactant sustem may comprise any of the groups of anionic, nonionic, cationic, amphoteric, and zwitterionic surfactants, or mixtures of these. The paste may be pumped into the agglomerator at a temperature high enough to maintain a pumpable viscosity, but low enough to avoid degradation of the anionic surfactants used. An operating temperature of the paste of 50° C. to 80° C. is typical.

A particularly suitable process of making surfactant particles from high active surfactant pastes is more fully described in EP 510 746, published on Oct. 28, 1992.

The term mean particle size as defined herein is calculated by sieving a sample of the composition into a number of fractions (typically 5 fractions) on a series of Tyler sieves. The weight fractions thereby obtained are plotted against the aperture size of the sieves. The mean particle size is taken to be the aperture size through which 50% by weight of the sample would pass. For the purposes of the present invention the surfactant containing granules should have a mean partle size of less than 480 micrometers, preferably less than 400 micrometers, and most preferably less than 350 micrometers.

Other Optional Ingredients

Detergent compositions of the present invention may, optionally, include anti-redeposition and soil suspension agents, bleach activators, optical brighteners, soil release agents, suds suppressors, enzymes, fabric softening agents, perfumes and colours, as well as other ingredients known to be useful in laundry detergents.

Anti-redeposition and soil-suspension agents suitable herein include cellulose derivatives such as methylcellulose, carboxymethylcellulose and hydroxyethycellulose, and homo-or co-polymeric polycarboxylic acids or their salts. Polymers of this type include copolymers of maleic anhydride with ethylene, methylvinyl ether or methacrylic acid, the maleic anhydride constituting at least 20 mole percent of the copolymer. These materials are normally used at levels of from 0.5% to 10% by weight, more preferably from 0.75% to 8%, most preferably from 1% to 6% by weight of the composition.

Other useful polymeric materials are the polyethylene glycols, particularly those of molecular weight 1000–10000, more particularly 2000 to 8000 and most preferably about 4000. These are used at levels of from 0.20% to 5% more preferably from 0.25% to 2.5% by weight. These polymers and the previously mentioned homo- or co-polymeric polycarboxylate salts are valuable for improving whiteness maintenance, fabric ash deposition, and cleaning performance on clay, proteinaceous and oxidizable soils in the presence of transition metal impurities.

In a preferred embodiment of the present invention, the composition comprises peroxyacid bleach precursor. The solid peroxyacid bleach precursors of the present invention comprise precursors containing one or more N- or O-acyl groups, which precursors can be selected from a wide range of classes.

Suitable classes include anhydrides, esters, imides and acylated derivatives of imidazoles and oximes, and examples of useful materials within these classes are disclosed in GB-A-1586789. The most preferred classes are esters such as are disclosed in GB-A-836988, 864,798, 1147871 and 2143231 and imides such as are disclosed in GB-A-855735 & 1246338.

Particularly preferred precursor compounds are the N,N, $N^1N^1$ tetra acetylated compounds of formula

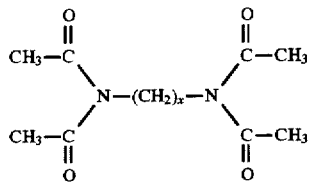

wherein x can be 0 or an integer between 1 & 6.

Examples include tetra acetyl methylene diamine (TAMD) in which x=1, tetra acetyl ethylene diamine (TAED) in which x=2 and tetraacetyl hexylene diamine (TAHD) in which x=6. These and analogous compounds are described in GB-A-907356. The most preferred peroxyacid bleach precursor is TAED.

Other activators are perbenzoic acid precursors such as benzoyloxybenzene sulphonate (BOBS) and benzoyl caprolactam.

Is is most preferred that a peroxyacid bleach precursor is present at a level of at least 0.5% by weight of the composition. The particles of peroxyacid bleach precursor preferably have a particle size of from 100 micrometers to 1500 micrometers.

These peroxyacid bleach precursors can be partially replaced by preformed peracids such as N,N phthaloylaminoperoxy acid (PAP), nonyl amide of peroxyadipic acid (NAPAA), 1,2 diperoxydodecanedioic acid (DPDA) and trimethyl ammonium propenyl imidoperoxy mellitic acid (TAPIMA). Other bleach precursors include glycolate esters (described in EP 507475); 4h-3,1-benzoxazin-4 ones; cationic precursors (described in EP 458396 and EP 464880); ester carbonate activators (described in EP 475511), NOBS, iso-NOBS.

Preferred optical brighteners are anionic in character, examples of which are disodium $4,4^1$-bis-(2-diethanolamino-4-anilino-s-triazin-6-ylamino)stilbene-$2:2^1$ disulphonate, disodium $4,4^1$-bis-(2-morpholino-4-anilino-2-triazin-6-ylaminostilbene-$2:2^1$-disulphonate,disodium 4, $4^1$-bis-(2,4-dianilino-s-triazin-6-ylamino)stilbene-$2:2^1$-disulphonate, monosodium $4^1,4^{11}$-bis-(2,4-dianilino-s-triazin-6 ylamino)stilbene-2- sulphonate, disodium $4,4^1$-bis-(2-anilino-4-(N-methyl-N-2-hydroxyethylamino)-2-triazin-6-ylamino)stilbene-$2,2^1$-disulphonate, disodium $4,4^1$-bis-(4-phenyl-2,1,3-triazol-2-yl)stilbene-$2,2^1$ disulphonate, disodium $4,4^1$bis(2-anilino-4-(1-methyl-2-hydroxyethylamino)-s-triazin-6-ylamino)stilbene-2, $2^1$disulphonate and sodium 2(stilbyl-$4^{11}$-(naphtho-$1^1,2^1$:4, 5)-1,2,3-triazole-$2^{11}$-sulphonate.

Soil-release agents useful in compositions of the present invention are conventionally copolymers or terpolymers of terephthalic acid with ethylene glycol and/or propylene glycol units in various arrangements. Examples of such polymers are disclosed in the commonly assigned U.S. Pat. Nos. 4116885 and 4711730 and European Published Patent Application No. 0272033. A particular preferred polymer in accordance with EP-A-0272033 has the formula $(CH_3(PEG)_{43})_{0.75}(POH)_{0.25}(T\text{-}PO)_{2.8}(T\text{-}PEG)_{0.4}]T(PO\text{-}H)_{0.25}((PEG)_{43}CH_3)_{0.75}$ where PEG is —$(OC_2H_4)O$—, PO is $(OC_3H_6O)$ and T is $(pCOC_6H_4CO)$.

Certain polymeric materials such as polyvinyl pyrrolidones typically of MWt 5000–20000, preferably 10000–15000, also form useful agents in preventing the transfer of labile dyestuffs between fabrics during the washing process.

Another optional detergent composition ingredient is a suds suppressor, exemplified by silicones, and silica-silicone mixtures. Silicones can be generally represented by alkylated polysiloxane materials while silica is normally used in finely divided forms, exemplified by silica aerogels and xerogels and hydrophobic silicas of various types. These materials can be incorporated as particulates in which the suds suppressor is advantageously releasably incorporated in a water-soluble or water-dispersible, substantially non-surface-active detergent-impermeable carrier. Alternatively the suds suppressor can be dissolved or dispersed in a liquid carrier and applied by spraying on to one or more of the other components.

As mentioned above, useful silicone suds controlling agents can comprise a mixture of an alkylated siloxane, of the type referred to hereinbefore, and solid silica. Such mixtures are prepared by affixing the silicone to the surface of the solid silica. A preferred silicone suds controlling agent is represented by a hydrophobic silanated (most preferably trimethyl-silanated) silica having a particle size in the range from 10 nanometers to 20 nanometers and a specific surface area above 50 $m^2/g$, intimately admixed with dimethyl silicone fluid having a molecular weight in the range from about 500 to about 200,000 at a weight ratio of silicone to silanated silica of from about 1:1 to about 1:2.

A preferred silicone suds controlling agent is disclosed in Bartollota et al. U.S. Pat. No. 3,933,672. Other particularly useful suds suppressors are the self-emulsifying silicone suds suppressors, described in German Patent Application DTOS 2,646,126 published Apr. 28, 1977. An example of such a compound is DC0544, commercially available from Dow Corning, which is a siloxane/glycol copolymer.

The suds suppressors described above are normally employed at levels of from 0.001% to 0.5% by weight of the composition, preferably from 0.01% to 0.1% by weight.

The preferred methods of incorporation comprise either application of the suds suppressors in liquid form by spray-on to one or more of the major components of the composition or alternatively the formation of the suds suppressors into separate particulates that can then be mixed with the other solid components of the composition. The incorporation of the suds modifiers as separate particulates also permits the inclusion therein of other suds controlling materials such as $C_{20}$–$C_{24}$ fatty acids, microcrystalline waxes and high MWt copolymers of ethylene oxide and propylene oxide which would otherwise adversely affect the dispersibility of the matrix. Techniques for forming such suds modifying particulates are disclosed in the previously mentioned Bartolotta et al U.S. Pat. No. 3,933,672.

Another optional ingredient useful in the present invention is one or more enzymes.

Preferred enzymatic materials include the commercially available amylases, neutral and alkaline proteases, lipases, esterases and cellulases conventionally incorporated into detergent compositions. Suitable enzymes are discussed in U.S. Pat. Nos. 3,519,570 and 3,533,139.

Fabric softening agents can also be incorporated into detergent compositions in accordance with the present invention. These agents may be inorganic or organic in type. Inorganic softening agents are examplified by the smectite clays disclosed in GB-A-1,400,898. Organic fabric softening agents include the water insoluble tertiary amines as disclosed in GB-A-1514276 and EP-B-0011340.

Their combination with mono $C_{12}$–$C_{14}$ quaternary ammonium salts is disclosed in EP-B-0026527 & 528. Other useful organic fabric softening agents are the dilong chain amides as disclosed in EP-B-0242919. Additional organic ingredients of fabric softening systems include high molecular weight polyethylene oxide materials as disclosed in EP-A-0299575 and 0313146.

Levels of smectite clay are normally in the range from 5% to 15%, more preferably from 8% to 12% by weight, with the material being added as a dry mixed component to the remainder of the formulation. Organic fabric softening agents such as the water-insoluble tertiary amines or dilong chain amide materials are incorporated at levels of from 0.5% to 5% by weight, normally from 1% to 3% by weight, whilst the high molecular weight polyethylene oxide materials and the water soluble cationic materials are added at levels of from 0.1% to 2%, normally from 0.15% to 1.5% by weight. Where a portion of the composition is spray dried, these materials can be added to the aqueous slurry fed to the spray drying tower, although in some instances it may be more convenient to add them as a dry mixed particulate, or spray them as a molten liquid on to other solid components of the composition.

EXAMPLES

All percentages in these examples are weight percentages:

| | Example 1 | Example 2 |
|---|---|---|
| C16/18 alkyl sulphate | 1.9 | 1.6 |
| Zeolite A (anhydrous basis) | 40.0 | 29.5 |
| Acrylic-Maleic co-polymer | 10.0 | 8.5 |
| Sodium Carbonate | 31.0 | 46.8 |
| DTPMP | 3.0 | 2.5 |
| Optical Brightener | 0.7 | 0.6 |
| Miscellaneous | 5.3 | 4.5 |
| Water (bound to zeolite) | 8.0 | 5.9 |
| Water (free) | 0.1 | 0.1 |

| | Example 3 | Example 4 | Example 5 |
|---|---|---|---|
| Spray dried powder (from Example 1) | 25.9 | — | 26.3 |
| Spray dried powder (from Example 2) | — | 30.9 | — |
| Sodium Percarbonate* | 17.5 | 13.0 | 16.3 |
| Enzyme Granulate* | 1.9 | 0.7 | 1.0 |
| Layered Silicate (SKS-6 ® ex Hoechst)* | 12.4 | 8.0 | 8.8 |
| Bleach Activator (TAED) Granulate | 6.0 | 2.7 | 2.8 |
| Sodium Bicarbonate* | 4.5 | 5.8 | 4.0 |
| Anionic Surfactant Granulate[1] | 25.0 | 20.7 | 23.4 |
| Suds Suppressor Granulate | 0.9 | 0.8 | 0.8 |
| Zeolite A | 1.3 | 3.0 | 3.0 |
| Nonionic Surfactant (sprayed on) | 4.6 | 4.6 | 4.6 |
| Sodium Sulphate* | — | 9.8 | 9.0 |

(DTPMP = diethylene triamine penta methylene phosphonate)

The granular components marked with an asterisk (*) in examples 3 to 5 have a bulk density of greater than 800 g/l.

The anionic surfactant granulate (indicated as [1]) in examples 3 to 5 comprises 35% by weight anionic surfactant, 26% by weight zeolite A, 28% sodium carbonate, 5% carboxymethyl cellulose, the balance being water.

What is claimed is:

1. A granular detergent component having a bulk density of less than 400 g/l comprising:

from 20% to 50%, by weight, of aluminosilicate;

up to 50%, by weight, of a co-filler; and from 0.05% to 2%, by weight, of C14–C20 alkyl sulphate anionic surfactant having a Krafft Point greater than 30° C. optionally mixed with other surfactants, the mixture of surfactants having a Krafft Point greater than 30° C.

2. A granular component according to claim 1, comprising from 10% to 30%, by weight, of a co-filler selected from the group consisting of hydratable salts, acids which are neutralized to form hydratable salts and mixtures thereof.

3. A granular component according to claim 2, wherein said co-filler is a salt selected from the group consisting of carbonates, bicarbonates, sesquicarbonates, sulfates, monomeric polycarboxylates, polycarboxylic acid homopolymers, polycarboxylic acid copolymers, organic phosphonates and mixtures thereof.

4. A granular detergent component according to claim 1 comprising from 0.5% to 10%, by weight, of a co-filler selected from the group consisting of polycarboxylic acid homopolymers, polycarboxylic acid copolymers and mixtures thereof.

5. A granular component according to claim 1, comprising from 1% to 1.8% by weight of the anionic surfactant.

6. A granular detergent component according to claim 1 comprising, by weight:

from 20% to 50% aluminosilicate;

up to 50% co-filler; and from 0.05% to 2% anionic surfactant; and wherein the granular detergent component is free of non-anionic surfactant.

7. A granular laundry detergent composition comprising:

(i) a first granular laundry detergent component having a bulk density of less than 400 g/l comprising:

from 20% to 50%, by weight, of aluminosilicate;

up to 50%, by weight, of a co-filler;

from 0.05 % to 2%, by weight, of C14–C20 alkyl sulphate anionic surfactant having a Krafft Point greater than 30° C., optionally mixed with other surfactants, the mixture of surfactants having a Krafft Point greater than 30° C.; and (ii) a second granular component having a bulk density of at least 800 g/l.

8. A granular composition according to claim 7, further comprising at least 3% by weight of granular percarbonate having a bulk density of at least 800 g/l.

9. A granular detergent composition according to claim 8 wherein the ratio of total water to aluminosilicate in the granular component of bulk density less than 400 g/l does not exceed 1:3.

10. A granular detergent composition according to claim 9 wherein the ratio of total water to aluminosilicate does not exceed 1:5.

11. A granular detergent composition according to claim 8 comprising from 5% to 30% by weight of percarbonate, the percarbonate being sodium percarbonate.

12. A granular detergent composition according to claim 7, wherein the second granular component (ii) comprises a member selected from the group consisting of silicates, layered silicates, carbonates, bicarbonates, sesquicarbonates, sulphates, citrates, citric acid, bleach activators, surfactants and mixtures thereof.

13. A granular detergent composition comprising, by weight:

(i) from 10% to 60% of a low bulk density component having a bulk density of less than 400 g/l comprising, by weight, from 20% to 50% aluminosilicate and from 0.05% to 2% anionic surfactant; and (ii) from 10% to 50% of a high bulk density component having a bulk density of greater than 800 g/l; and wherein the low bulk density component has a total surfactant mixture Krafft Point greater than 30° C. and is free of non-anionic surfactant.

14. A granular detergent composition according to claim 13 wherein the low bulk density component further comprises a co-filler, and further wherein the co-filler comprises a member selected from the group consisting of carbonates, bicarbonates, sesquicarbonates, sulfates, monomeric polycarboxylates, polycarboxylic acid homopolymers, polycarboxylic acid copolymers, organic phosphonates and mixtures thereof.

15. A granular detergent composition according to claim 14 wherein co-filler is present at a level of up to 50%, by weight of the low bulk density component.

16. A granular detergent composition according to claim 14 wherein the low bulk density component comprises from 0.5% to 10%, by weight, of a co-filler selected from the group consisting of polycarboxylic acid homopolymers, polycarboxylic acid copolymers and mixtures thereof.

17. A granular detergent composition according to claim 13, wherein the high bulk density component comprises a member selected from the group consisting of silicates, layered silicates, percarbonates, carbonates, bicarbonates, sesquicarbonates, sulphates, citrates, citric acid, bleach activators, surfactants and mixtures thereof.

18. A granular detergent composition according to claim 17 wherein the high bulk density component comprises a member selected from the group consisting of sodium silicates, percarbonates and mixtures thereof.

19. A granular detergent composition according to claim 13 further comprising, by weight of the detergent composition, at least 0.5% of a peroxyacid bleach precursor.

20. A granular detergent composition according to claim 13 wherein the aluminosilicate of the low bulk density component is hydrated and contains from 10% to 28% water in bound form.

21. A granular detergent composition according to claim 13 wherein the low bulk density component comprises, by weight:

from 20% to 50% aluminosilicate;

up to 50% co-filler; and from 0.05% to 2% anionic surfactant.

* * * * *